US012680726B2

(12) United States Patent
Yajima

(10) Patent No.: US 12,680,726 B2
(45) Date of Patent: Jul. 14, 2026

(54) AIR CONDITIONER

(71) Applicant: DAIKIN INDUSTRIES, LTD., Osaka (JP)

(72) Inventor: Ryuzaburo Yajima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 266 days.

(21) Appl. No.: 18/323,020

(22) Filed: May 24, 2023

(65) Prior Publication Data

US 2023/0296286 A1 Sep. 21, 2023

Related U.S. Application Data

(63) Continuation of application No. PCT/JP2021/043421, filed on Nov. 26, 2021.

(30) Foreign Application Priority Data

Dec. 2, 2020 (JP) ..... 2020-200012

(51) Int. Cl.
*F24F 13/20* (2006.01)
*F24F 1/38* (2011.01)
*F24F 11/30* (2018.01)

(52) U.S. Cl.
CPC ..... *F24F 13/20* (2013.01); *F24F 1/38* (2013.01); *F24F 11/30* (2018.01)

(58) Field of Classification Search
CPC .... F24F 1/38; F24F 11/30; F24F 11/36; F24F 11/89; F24F 13/20; F24F 13/14;
(Continued)

(56) References Cited

U.S. PATENT DOCUMENTS

2012/0247444 A1 10/2012 Sherrow et al.
2015/0219343 A1 8/2015 Moriwaki et al.
(Continued)

FOREIGN PATENT DOCUMENTS

JP S57-3979 U 1/1982
JP H11-132496 A 5/1999
(Continued)

OTHER PUBLICATIONS

Machine Translation JP2020051734 (Year: 2020).*
(Continued)

*Primary Examiner* — Joseph F Trpisovsky
(74) *Attorney, Agent, or Firm* — Osha Bergman Watanabe & Burton LLP

(57) ABSTRACT

An air conditioner includes: a heat exchanger that exchanges heat between air sent to an air conditioning target space and a flammable refrigerant; a fan that generates an air flow in the heat exchanger; one of a heater that heats the air sent to the air conditioning target space, or an electric apparatus that is capable of causing electric discharge; a casing that has an arrangement space in which the heat exchanger, the fan, and the heater or the electric apparatus is disposed, and an opening that communicates the arrangement space with outdoors; and an opening and closing part that opens and closes the opening. The opening and closing part: closes the opening in response to the fan being driven, and opens the opening in response to the fan being stopped.

7 Claims, 13 Drawing Sheets

(58) Field of Classification Search
CPC ..... F24F 2221/34; F24F 7/10; F25D 2400/24; F25D 2400/12; F25B 2500/22
See application file for complete search history.

(56) References Cited

U.S. PATENT DOCUMENTS

| | | | | |
|---|---|---|---|---|
| 2016/0363358 | A1 | 12/2016 | Papas et al. | |
| 2021/0325081 | A1 | 10/2021 | Kagawa et al. | |
| 2022/0034535 | A1 | 2/2022 | Kobayashi et al. | |
| 2022/0065469 | A1 | 3/2022 | Yajima | |
| 2022/0307711 | A1* | 9/2022 | Lord ..... | F24F 13/10 |

FOREIGN PATENT DOCUMENTS

| | | | |
|---|---|---|---|
| JP | 2007-212003 | A | 8/2007 |
| JP | 2015-94512 | A | 5/2015 |
| JP | 2015-145764 | A | 8/2015 |
| JP | 2016-176673 | A | 10/2016 |
| JP | 2020-51734 | A | 4/2020 |
| JP | 2020-106250 | A | 7/2020 |
| WO | 2020/044539 | A1 | 3/2020 |

OTHER PUBLICATIONS

Machine Translation JP2020106250 (Year: 2020).*
International Preliminary Report on Patentability issued in corresponding International Application No. PCT/JP2021/043421, mailed Jun. 15, 2023 (6 pages).
International Search Report issued in corresponding International Application No. PCT/JP2021/043421 mailed Feb. 15, 2022 (3 pages).

* cited by examiner

AIR CONDITIONER

CROSS-REFERENCE TO RELATED APPLICATIONS

This is a continuation application of International Patent Application No. PCT/JP2021/043421, filed on Nov. 26, 2021, and claims priority to Japanese Patent Application No. 2020-200012, filed on Dec. 2, 2020. The contents of these priority applications are incorporated herein by reference.

TECHNICAL FIELD

The present disclosure relates to an air conditioner.

BACKGROUND

Conventionally, for example, as disclosed in Patent Literature 1 (JP 2015-94512 A), an air conditioner using a flammable refrigerant is known.

SUMMARY

An air conditioner according to one or more embodiments includes a heat exchanger, a fan, a heating part or an electric apparatus, a casing, and an opening and closing part. A heat exchanger exchanges heat between air sent to an air conditioning target space and a flammable refrigerant. A fan generates an air flow in the heat exchanger. The heating part heats the air sent to the air conditioning target space. The electric apparatus may cause electric discharge. The casing has an arrangement space in which the heat exchanger, the fan, and the heating part or the electric apparatus are disposed, and has an opening that communicates the arrangement space with outdoors. The opening and closing part opens and closes the opening. The opening and closing part closes the opening when the fan is driven, and opens the opening when the fan is stopped.

DETAILED DESCRIPTION

(1) Overall Configuration

Figure 1:
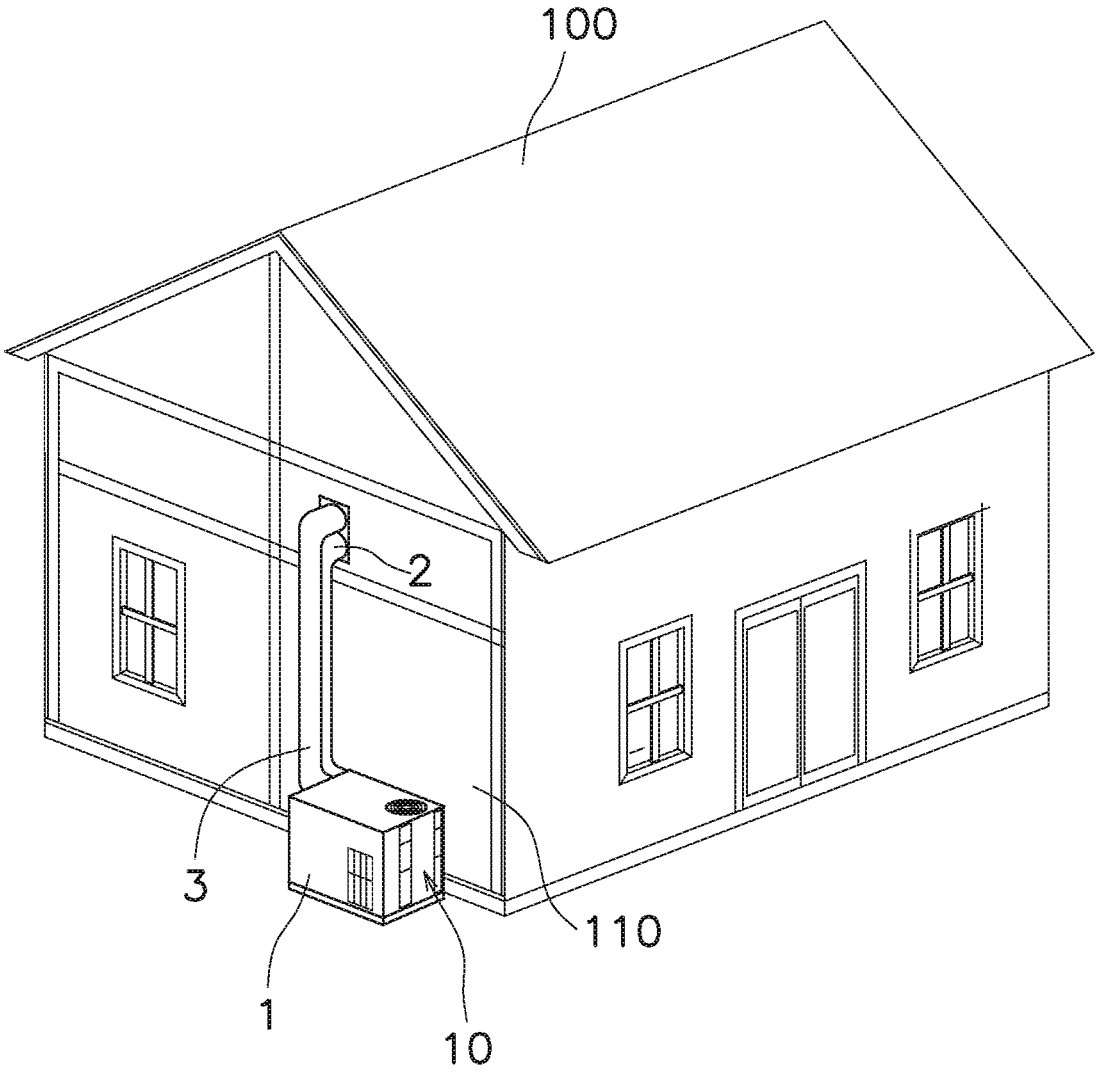
FIG. 1 is a perspective view of an air conditioner and a building according to one or more embodiments.

As shown in FIG. 1, an air conditioner 1 is installed outdoors outside a building 100. An air supply duct 2 and a return air duct 3 are connected to the air conditioner 1. The air supply duct 2 rises from the air conditioner 1, passes through a wall surface 110 of the building 100, and extends into the building 100. The air conditioner 1 supplies conditioned air into the building 100 through the air supply duct 2. The return air duct 3 passes through the wall surface 110 of the building 100 from inside of the building 100, falls toward the air conditioner 1, and extends to the air conditioner 1. The conditioned air supplied from the air conditioner 1 through the air supply duct 2 causes air conditioning in the building 100. In this case, the inside of the building 100 is an air conditioning target space. In other words, the air conditioning target space is a space where the conditioned air supplied from the air conditioner 1 causes air conditioning. Here, a case where the entire building 100 is an air conditioning target space will be described as an example, but the air conditioning target space is not limited to such a case. For example, a specific room in the building 100 may be the air conditioning target space. In addition, here, one detached house is exemplified as the building 100, but the building 100 is not limited to one detached house. The building 100 may be, for example, an apartment building, an office building, a commercial facility, a warehouse, or a factory.

FIG. 1 shows an example in which the air conditioner 1 is installed on a ground. The air supply duct 2 and the return air duct 3 of the air conditioner 1 shown in FIG. 1 lead to an attic of the building 100 after being raised from the air conditioner 1. However, a method of installing the air conditioner 1 is not limited to a method shown in FIG. 1. For example, the air conditioner 1 may be installed on the ground, and the air supply duct 2 and the return air duct 3 connected to the air conditioner 1 may be configured to be raised to a rooftop of a commercial facility. Alternatively, the air conditioner 1 may be installed on the ground such that the air supply duct 2 and the return air duct 3 are horizontally installed and lead to an underfloor space.

(2) Detailed Configurations (2-1) Configuration of Air Conditioner

Figure 2:
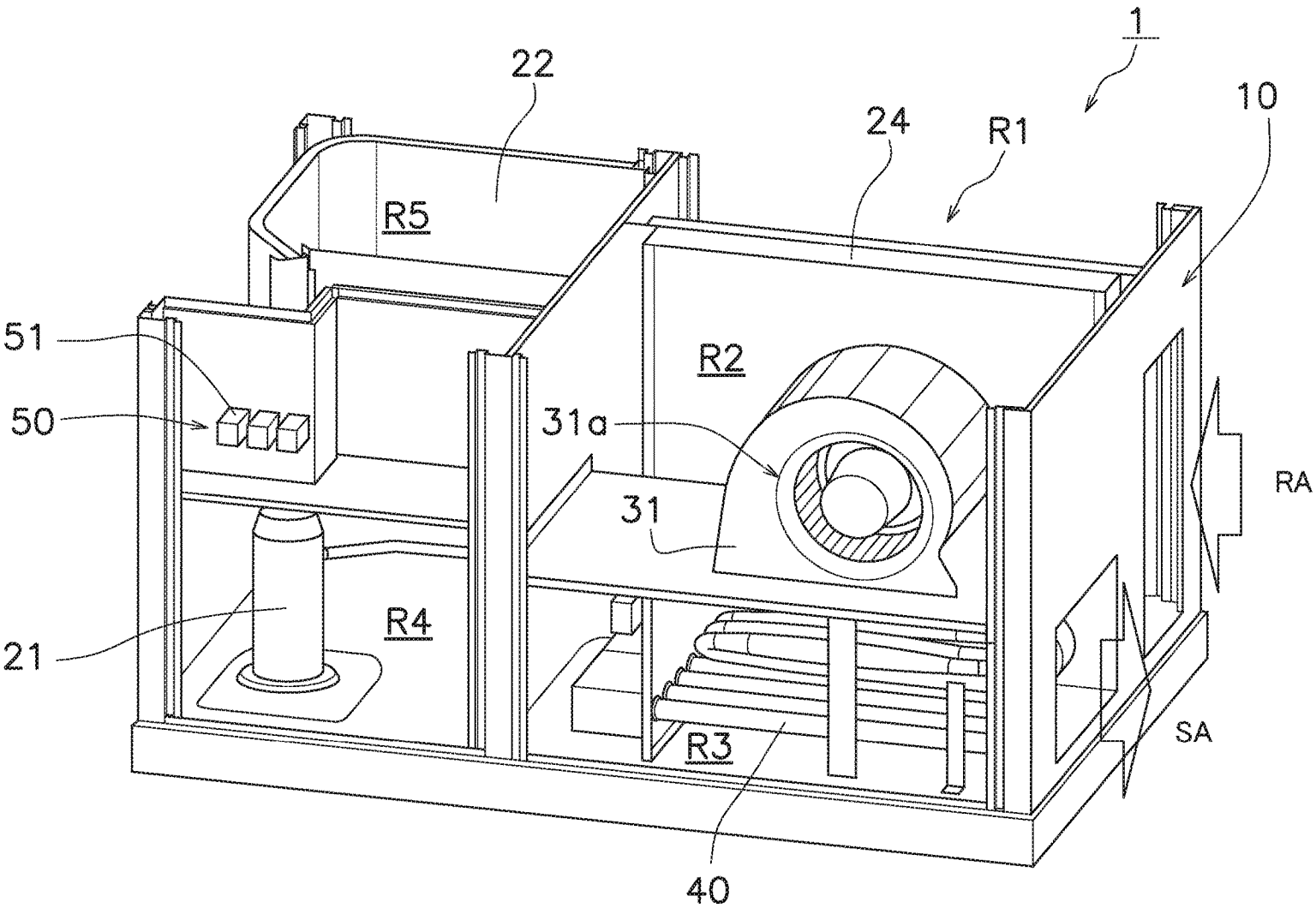
FIG. 2 is a perspective view for describing an internal configuration of the air conditioner of FIG. 1.
Figure 3:
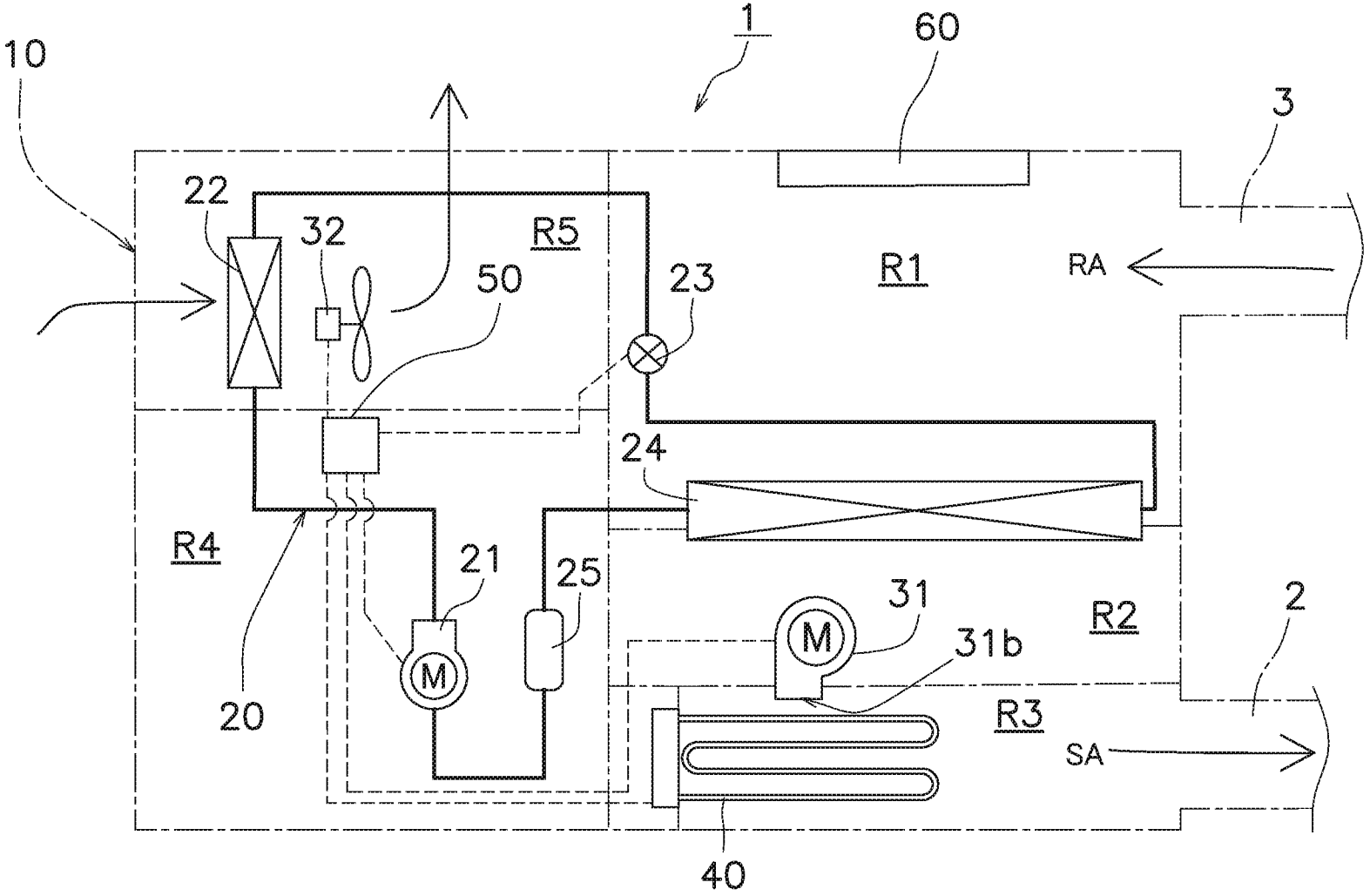
FIG. 3 is a schematic diagram showing an example of an outline of a configuration of the air conditioner.

The air conditioner 1 includes a casing 10. The casing 10 of the air conditioner 1 shown in FIG. 1 has a shape based on a rectangular parallelepiped. In other words, the casing 10 has six front, rear, left, right, upper, and lower surfaces that cover the space inside the air conditioner 1. FIG. 2 shows the air conditioner 1 in a state in which some plate members constituting the casing 10 are removed to expose internal devices. FIG. 3 shows an outline of the configuration of the air conditioner 1. The space in the casing 10 is partitioned into five parts. In other words, the casing 10 has a first chamber R1, a second chamber R2, a third chamber R3, a fourth chamber R4, and a fifth chamber R5 partitioned from each other.

The air conditioner 1 includes a refrigerant circuit 20 through which a refrigerant flows, a first fan 31, a second fan 32, a furnace burner unit 40, a control unit 50, and an opening and closing part 60. The refrigerant circuit 20 includes a compressor 21, a condenser 22, an expansion valve 23, an evaporator 24, and an accumulator 25. The evaporator 24 is a heat exchanger that exchanges heat between air sent to the air conditioning target space and a flammable refrigerant. The first fan 31 is a fan that generates an air flow in the evaporator 24 which is a heat exchanger.

The refrigerant circuit 20 achieves a vapor compression refrigeration cycle. Therefore, the refrigerant circulates in the refrigerant circuit 20. A flammable refrigerant is used in the refrigerant circuit 20. Examples of the flammable refrigerant include an A2L refrigerant. Examples of the A2L refrigerant include an R32 refrigerant and an R454B refrigerant.

During cooling, a gas refrigerant compressed by the compressor 21 of the refrigerant circuit 20 is sent to the condenser 22. The refrigerant radiates heat to outdoor air in the condenser 22, and is sent to the expansion valve 23 through a refrigerant pipe. In the expansion valve 23, the refrigerant is expanded and decompressed. The refrigerant decompressed in the expansion valve 23 is sent to the evaporator 24. The low-temperature and low-pressure refrigerant sent from the expansion valve 23 exchanges heat in the evaporator 24 to take heat from the air passing through the evaporator 24. The air exchanging heat in the evaporator 24 is air RA returning from the building 100 through the return air duct 3. The air removed of heat and cooled by the evaporator 24 is supplied to the building 100 through the air supply duct 2. A gas refrigerant or a gas-liquid two-phase refrigerant having exchanged heat in the evaporator 24 flows through the accumulator 25 and is sucked to the compressor 21.

During heating, the air warmed by the furnace burner unit 40 is supplied to the building 100 through the air supply duct 2. The air RA returning from the building 100 through the return air duct 3 is sent to the furnace burner unit 40 by the first fan 31.

The first chamber R1 is connected to the return air duct 3. The evaporator 24 is disposed between the first chamber R1 and the second chamber R2. The air having passed through the evaporator 24 from the first chamber R1 enters the second chamber R2. In the second chamber R2, the first fan 31 is disposed. A suction port 31*a* (see FIG. 2) of the first fan 31 is open to the second chamber R2. A blow-out port 31*b* (see FIG. 3) of the first fan 31 is open to the third chamber R3. The first fan 31 blows air from the second chamber R2 to the third chamber R3. The furnace burner unit 40 is disposed in the third chamber R3, and the air supply duct 2 is connected the third chamber R3. The air sent by the first fan 31 is warmed by the furnace burner unit 40 and sent from the third chamber R3 to the building 100 through the air supply duct 2 in some cases. Alternatively, in other cases, the air sent by the first fan 31 is sent from the third chamber R3 to the building 100 through the air supply duct 2 without being warmed by the furnace burner unit 40.

In the fourth chamber R4, the compressor 21, the accumulator 25, and the control unit 50 are disposed. In the fifth chamber R5, the condenser 22 and the second fan 32 are disposed. Outdoor air is sucked into the fifth chamber R5 by the second fan 32, and the air passing through the condenser 22 is discharged from the fifth chamber R5 to outdoors. Therefore, even when the refrigerant leaks from the condenser 22 in the fifth chamber R5, the risk that the refrigerant staying in the fifth chamber R5 burns is extremely small. Arrows shown in the fifth chamber R5 indicate flows of air sucked from outdoors and air discharged to outdoors by the second fan 32.

Since the refrigerant has a density higher than a density of air, the refrigerant tends to fall downward in the air and accumulate at a low position due to a difference in gravity applied to the refrigerant and the air. When the air conditioner 1 is installed on the ground, the refrigerant leaking at or around the evaporator 24 tends to stay in the air supply duct 2 and the return air duct 3 and in the casing 10, unlike when the air conditioner 1 is installed on the rooftop. The volume in the air supply duct 2, the return air duct 3, and the casing 10 is smaller than the volume in the interior of the building 100. Therefore, as compared with a case where the air conditioner 1 is installed on the rooftop, in a case where the air conditioner 1 is installed on the ground or the like, the refrigerant is concentrated in the casing 10, the air supply duct 2, and the return air duct 3, and thus the risk that the concentration of the leaking refrigerant exceeds a lower flammability limit concentration increases.

When the refrigerant leaks at or around the evaporator 24, the leaking refrigerant first accumulates in the first chamber R1, the second chamber R2, and the return air duct 3. The refrigerant accumulated in the first chamber R1, the second chamber R2, and the return air duct 3 then leaks to the third chamber R3 in which the furnace burner unit 40 is provided, the fourth chamber R4 in which the compressor 21, the control unit 50, and the like are provided, and the fifth chamber R5 in which the condenser 22 is provided, through a small gap opened in a partition plate separating the first to fifth chambers R1 to R5, the first fan 31, and the like.

In the casing 10, a heating part (i.e., heater) or an electric apparatus that can be possibly an ignition source of the refrigerant exceeding the combustion lower limit concentration is disposed. The heating part is a component having a higher temperature than the other components during operation. The electric apparatus is a device that can possibly cause electric discharge during operation. In other words, the electric apparatus is a device can possibly make a spark fly. Examples of the heating part include the furnace burner unit 40 and an electric heater (not shown) to be described later. Examples of the electric apparatus that can possibly cause electric discharge include an electromagnetic relay 51 and an electrostatic precipitator (not shown). Although there are many components other than the electromagnetic relay 51 in the control unit 50, the components other than the electromagnetic relay 51 are not shown in FIG. 2.

The first chamber R1 is provided with an opening and closing part 60 for preventing a concentration of a refrigerant leaking from exceeding the combustion lower limit concentration when the refrigerant leaks at or around the evaporator 24. The opening and closing part 60 opens and closes an opening that communicates from the first chamber R1 to outside of the casing 10.

(2-2) Opening and Closing Part 60

Figure 4:
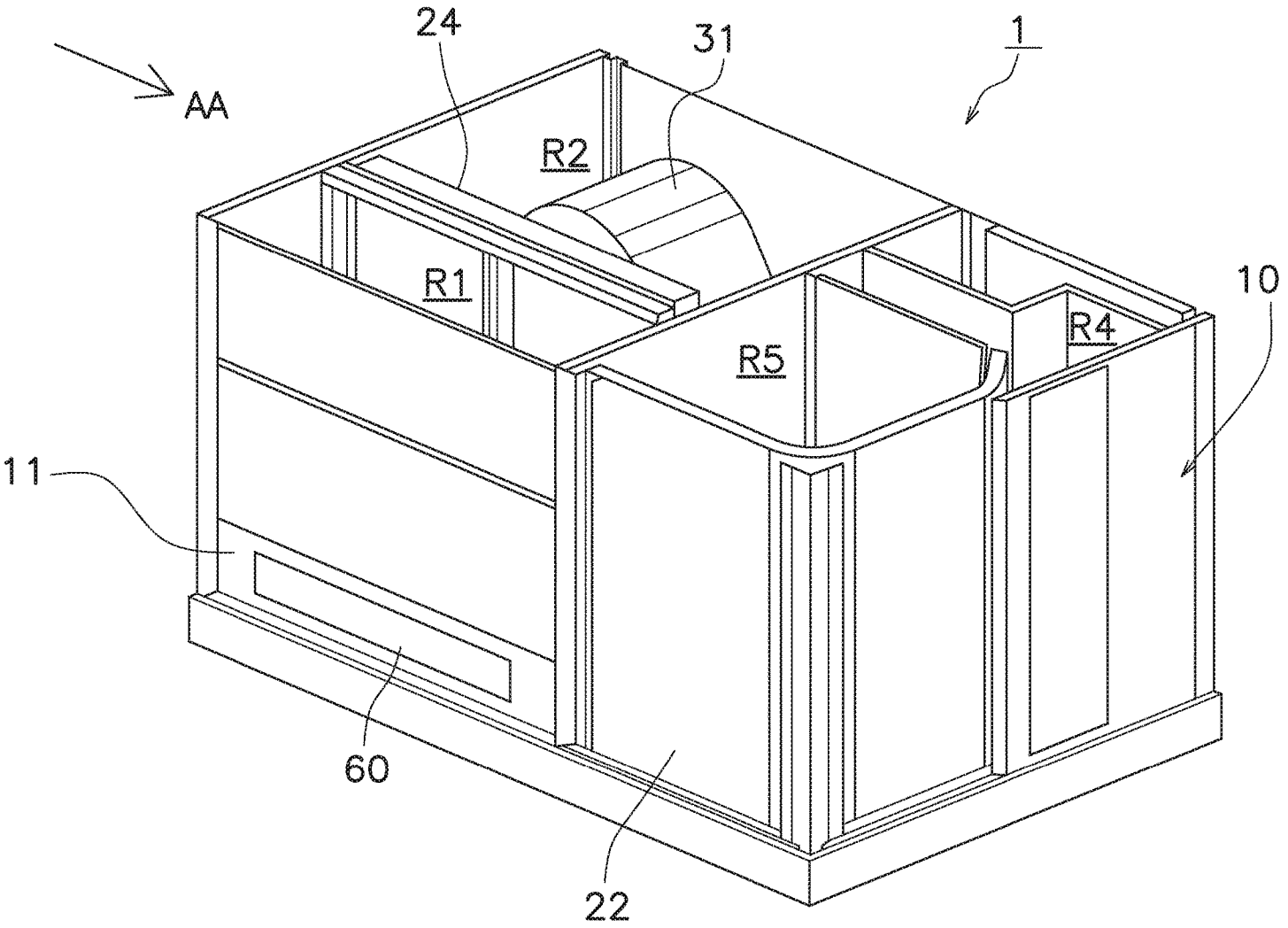
FIG. 4 is a perspective view of the air conditioner showing an example of an arrangement position of an opening and closing part.
Figure 5:
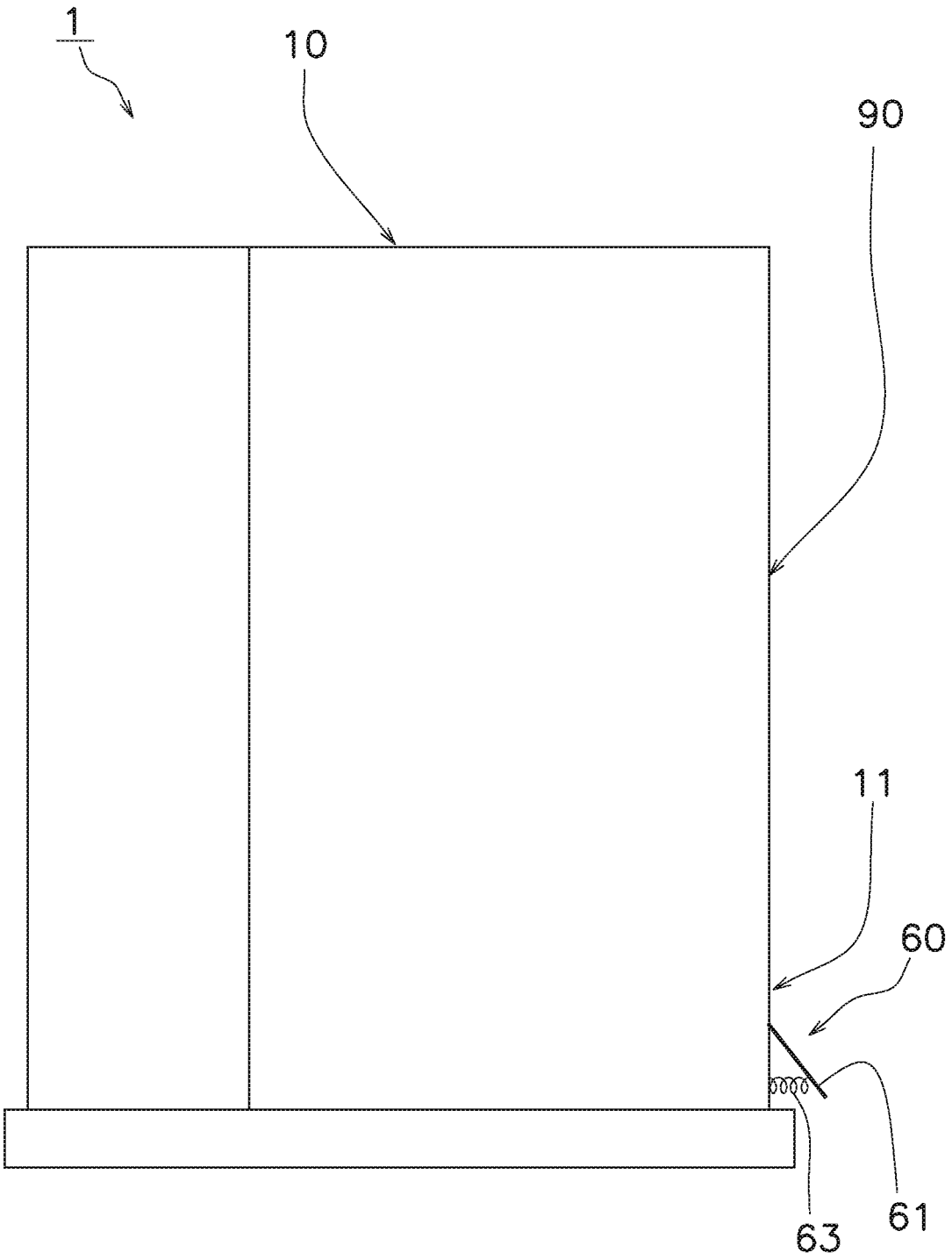
FIG. 5 is a side view of the air conditioner for describing a state in which a lid of the opening and closing part is open.
Figure 6:
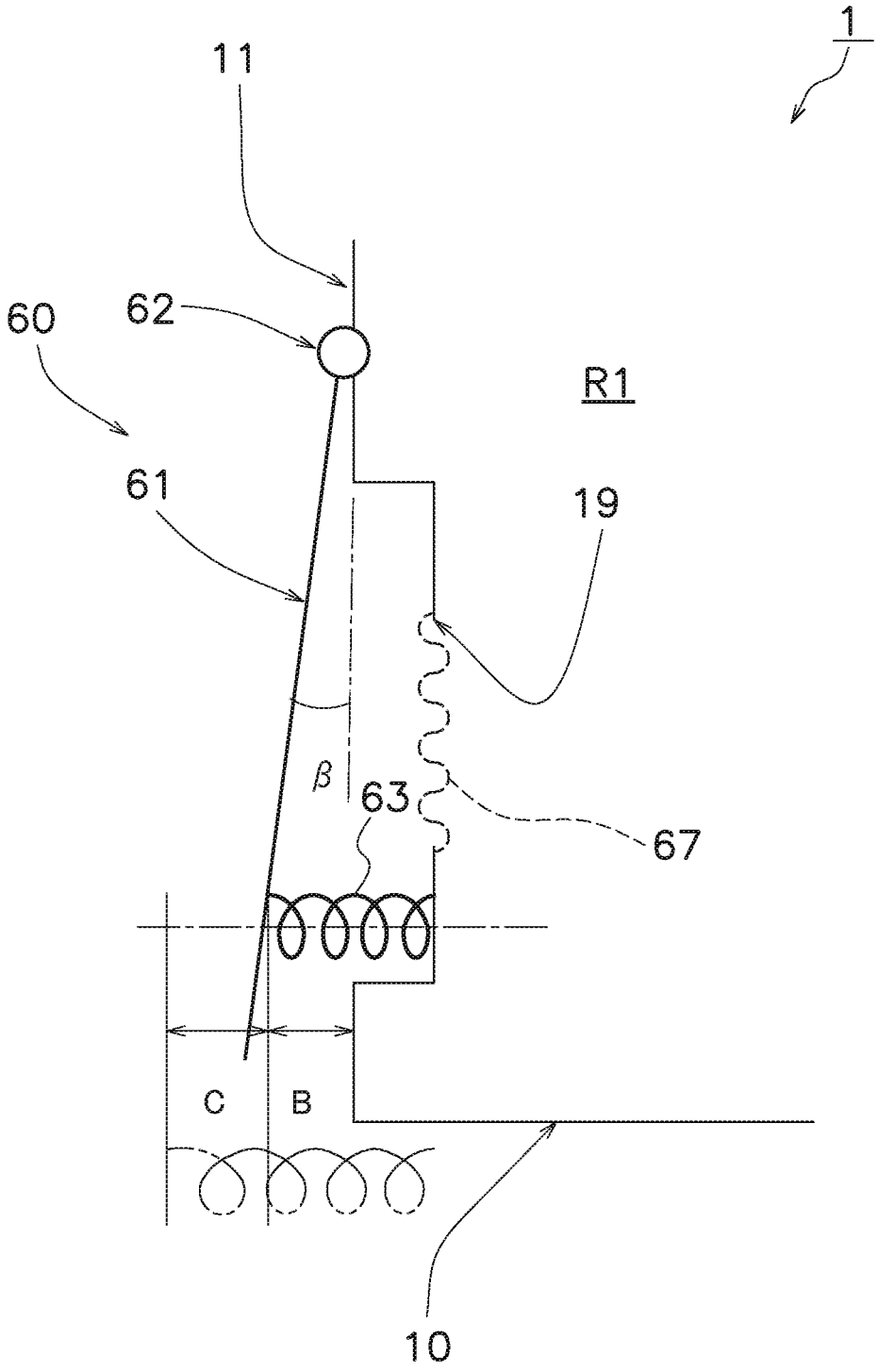
FIG. 6 is a schematic sectional view showing an example of a configuration of the opening and closing part.

FIG. 4 shows an arrangement position of the opening and closing part 60 in the casing 10. In FIG. 4, as in FIG. 2, a part of the plate member of the casing 10 is removed. The opening and closing part 60 is provided on a side plate 11 of the casing 10. The side plate 11 is a plate member that partitions the outside of the casing 10 and a space in the first chamber R1. The side plate 11 constitutes a part of a side surface of the first chamber R1. FIG. 5 shows the casing 10 viewed from an AA direction indicated by an arrow in FIG. 4. A lid 61 is shown protruding outward from the side plate 11 of the casing 10. FIG. 6 schematically shows a cross section of the opening and closing part 60 as viewed from the fourth chamber R4 and the fifth chamber R5. As shown in FIG. 6, the lid 61 can open and close an opening 19 by rotating about a fulcrum with a hinge 62. Therefore, the lid 61 has a shape slightly larger than the opening 19. In other words, when the opening 19 is closed by the lid 61, the lid 61 and the side plate 11 overlap around the opening 19. The opening 19 is provided with a filter 67. The filter 67 prevents dust and insects from entering the casing 10.

As shown in FIG. 5, when the lid 61 of the opening and closing part 60 is open, the air conditioner 1 is in a state where the first fan 31 is stopped. In other words, when the first fan 31 is stopped, the opening and closing part 60 opens the opening 19 so that air can enter and exit between the first chamber R1, the second chamber R2, the third chamber R3, and the fourth chamber R4 and the outdoors. In other words, the state in which the opening 19 is opened so that air can enter and exit is a state in which the leaking refrigerant can be discharged to the outside of the casing 10 through the opening 19. In the air conditioner 1, the second chamber R2, the third chamber R3, and the fourth chamber R4 are an arrangement space, the furnace burner unit 40 which is a heating part is disposed in the third chamber R3, and the electromagnetic relay 51 which is the electric apparatus that may cause electric discharge is disposed in the fourth chamber R4. The first chamber R1, the second chamber R2, the third chamber R3, and the fourth chamber R4 are partitioned by a partition, but communicate with each other by the gap of the partition plate or the like. Therefore, when the first chamber R1 communicates with the outside by the opening 19 of the opening and closing part 60, the second chamber R2, the third chamber R3, and the fourth chamber R4 also communicate with the outdoors. When the first fan 31 is driving, the opening and closing part 60 closes the opening 19 so that air cannot enter and exit between the first chamber R1, the second chamber R2, the third chamber R3, and the fourth chamber R4 and the outdoors.

Specifically, a spring 63 is provided between the lid 61 and the casing 10 so that the lid 61 is supported by the spring 63 to open the opening 19 of the opening and closing part 60 when the first fan 31 is stopped. FIG. 6 shows a state of the opening and closing part 60 when the first fan 31 is stopped. A force generated by gravity applied to the lid 61 shown in FIG. 6 and a repulsive force H [N] of the spring 63 are balanced. The spring 63 contracts by a distance C [mm] from a free state in which no force is applied to the spring 63. The spring 63 in the free state is indicated by a two-dot chain line in FIG. 6. As shown in FIG. 6, an inclination angle of the lid 61 when the lid 61 rotates by the distance C and the forces are balanced is β [degrees]. Assuming that a mass of the lid 61 is W [kg] and a gravitational acceleration is g [m/s$^2$], a magnitude of a horizontal force generated by gravity W×g applied to the lid 61 is W×g×tan β. Assuming that a spring constant is K [N/mm], a balance between the horizontal force generated by the gravity applied to the lid 61 and the repulsive force H of the spring 63 is expressed by the following formula (1).

$$H=K\times C=W\times g\times\tan\beta \quad (1)$$

Figure 7:
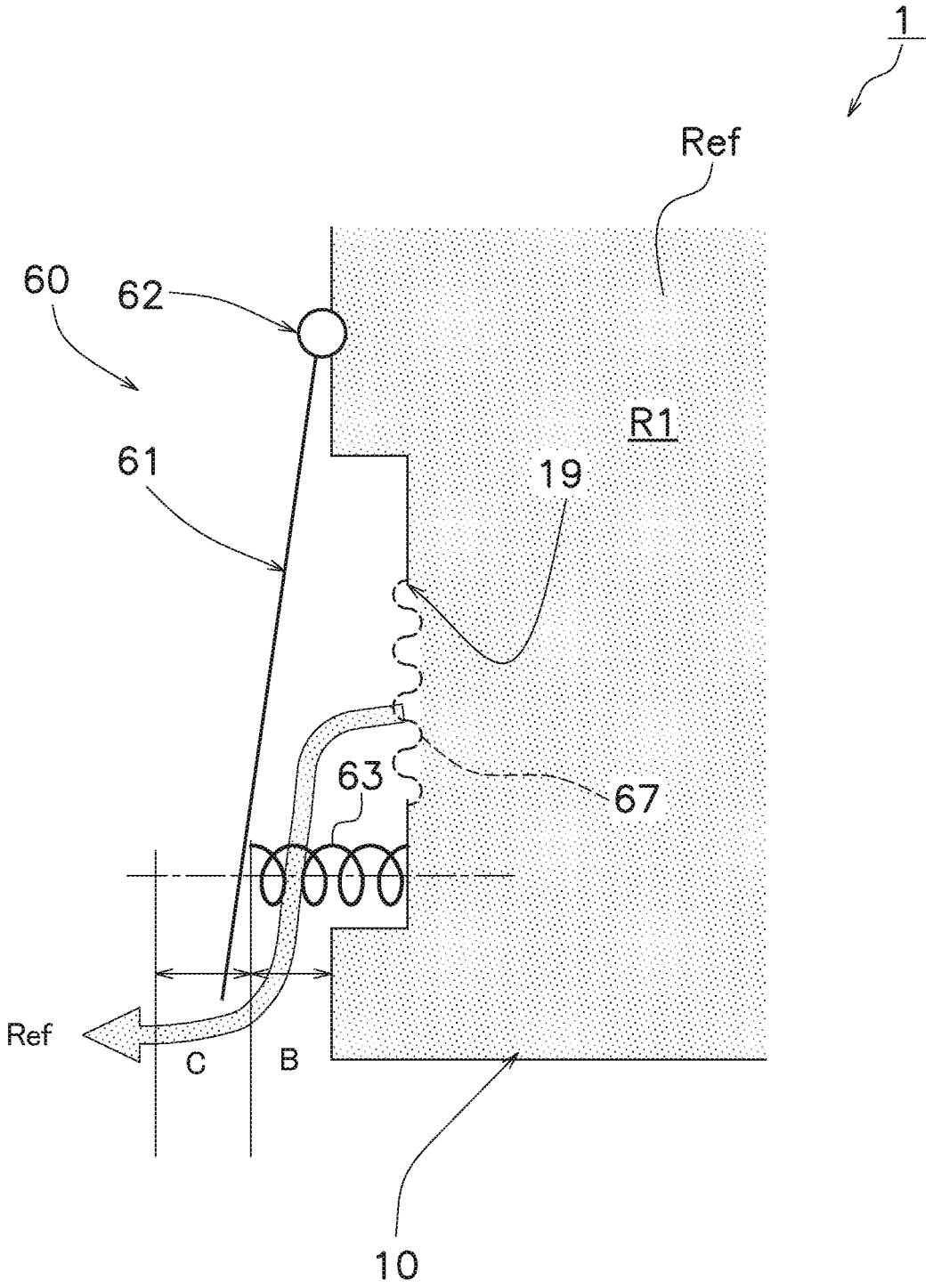
FIG. 7 is a schematic sectional view of the opening and closing part for describing that a leaking refrigerant is discharged to outdoors from the opening and closing part.

In FIG. 7, a leaking refrigerant Ref discharged to the outside of the casing 10 from the opening 19 opened by the opening and closing part 60 is indicated by an arrow. Since a density of the refrigerant Ref is larger than a density of the air, the leaking refrigerant Ref is discharged to the outside of the casing 10 through the opening 19 due to a density difference between the refrigerant Ref and the air.

Figure 8:
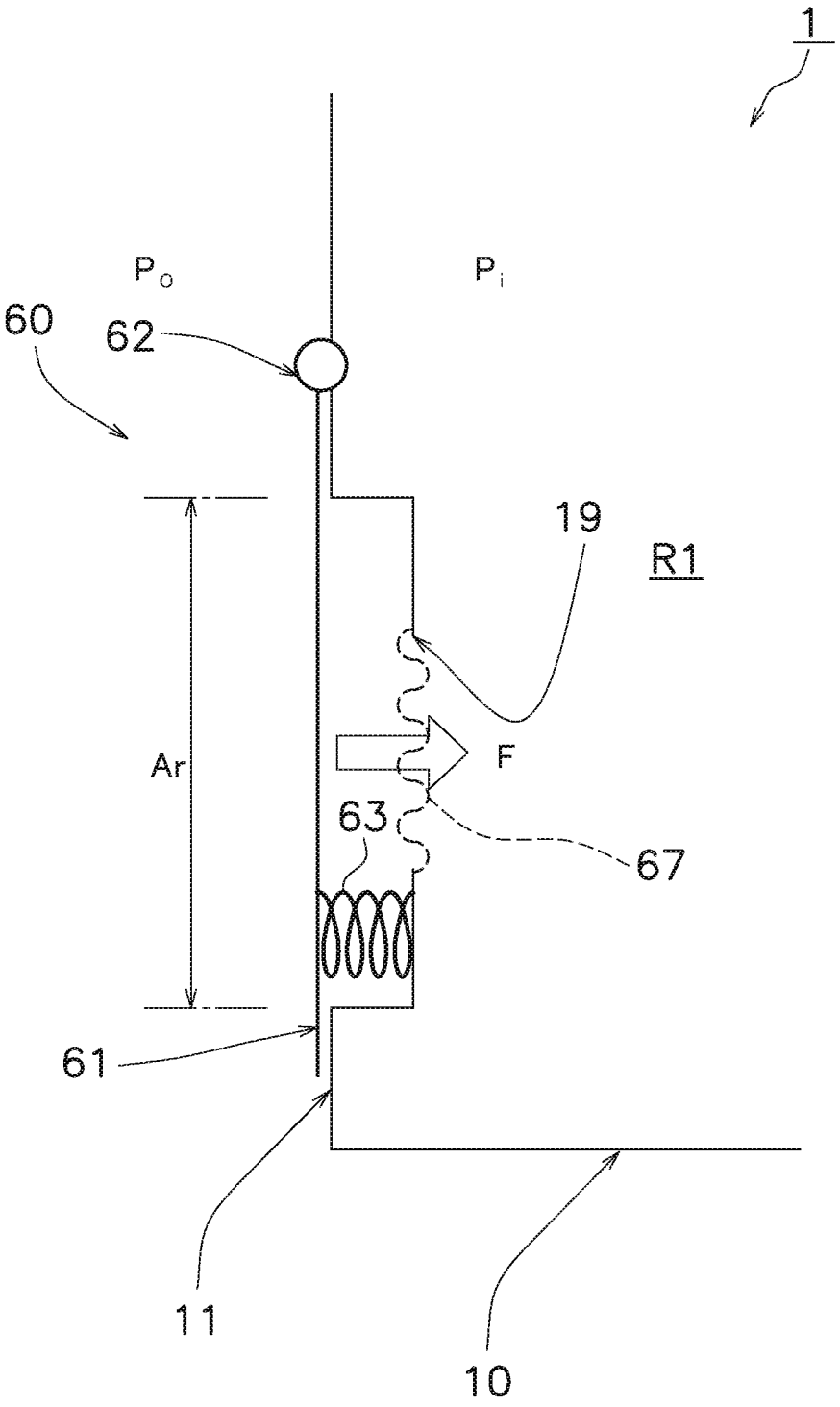
FIG. 8 is a sectional view of the opening and closing par for describing a state in which the opening and closing part is closed.

FIG. 8 shows a state in which the opening 19 is closed by the lid 61 of the opening and closing part 60 during operation of the fan. When the first fan 31 is driven, air pressure Pi in the first chamber R1 becomes lower than atmospheric pressure Po outside the casing 10. An airflow blown into the first chamber R1 from the outside of the casing 10 through the opening 19 is generated by an air pressure difference ΔP (=Po−Pi) between the inside and the outside. Since this airflow mainly flows inside the lid 61, the pressure inside the lid 61 decreases. Therefore, a force directed from the outside of the lid 61 to the inside of the lid 61 is generated by the airflow passing through the opening 19, and the lid 61 is closed by this force. The spring 63 is designed to contract to a position where the lid 61 is closed by this force.

Figure 9:
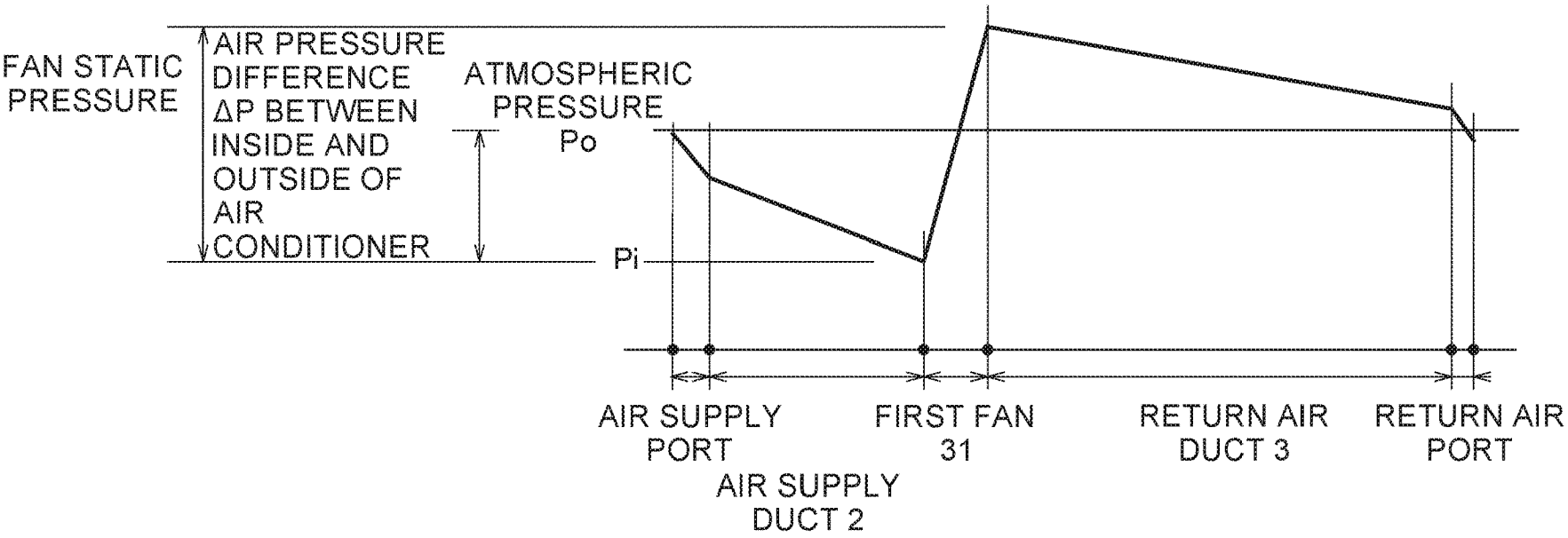
FIG. 9 is a graph showing static pressures of the air conditioner, an air supply duct, and a return air duct.

FIG. 9 shows static pressure distributions of the air conditioner 1, the air supply duct 2, and the return air duct 3 when the air conditioner 1 is operated with the lid 61 closed. An air supply port shown in FIG. 9 is an opening that is open to the air conditioning target space in the building 100. One end of the air supply duct 2 is connected to the air supply port. The other end of the air supply duct 2 is connected to the air conditioner 1. A return air port shown in FIG. 9 is an opening that is open to the air conditioning target space in the building 100. One end of the return air duct 3 is connected to the return air port. The other end of the return air duct 3 is connected to the air conditioner 1.

When the lid 61 is closed, the lid 61 is pressed against the side plate 11 of the casing 10 by the air pressure difference ΔP between the inside and the outside. In other words, the air pressure difference ΔP between the inside and the outside overcomes a repulsive force of the spring 63, and the lid 61 closes the opening 19. In order for the lid 61 to keep closing the opening 19, a pressing force Fp generated by the air pressure difference ΔP is required to be larger than a repulsive force Fs of the spring 63. When an area of the opening 19 is Ar [m$^2$], the air pressure difference is ΔP [Pa], the number of springs is n, and a contraction margin of the spring 63 from the free state is (B+C) [mm] in a state where the lid 61 is closed, the following formulas (2), (3), and (4) are satisfied.

$$Fp=\Delta P\times Ar \quad (2)$$

$$Fs=n\times K\times(B+C) \quad (3)$$

$$Fp>Fs \quad (4)$$

The lid 61 may include metal, for example, in order to increase the weight of the lid 61. The lid 61 includes iron, for example.

(3) Modifications (3-1) Modification A

In the above embodiments, the case has been described where a refrigerant flow direction in the refrigerant circuit 20 is constant and the condenser 22 and the evaporator 24 are not switched. However, the refrigerant circuit used in the air conditioner 1 may be configured such that a refrigerant flow direction is switched by, for example, a four-way valve. In the case where the refrigerant flow is switched as described above, the evaporator 24 can be switched to operate as a condenser, and the condenser 22 can be switched to operate as an evaporator.

(3-2) Modification B

In the above embodiments, the case has been described where the spring 63 is used as a member that supports the lid 61 when the opening and closing part 60 is open. Alternatively, the member supporting the lid 61 may be an elastic body other than the spring 63. Examples of the elastic body include rubber.

(3-3) Modification C

Figure 10:
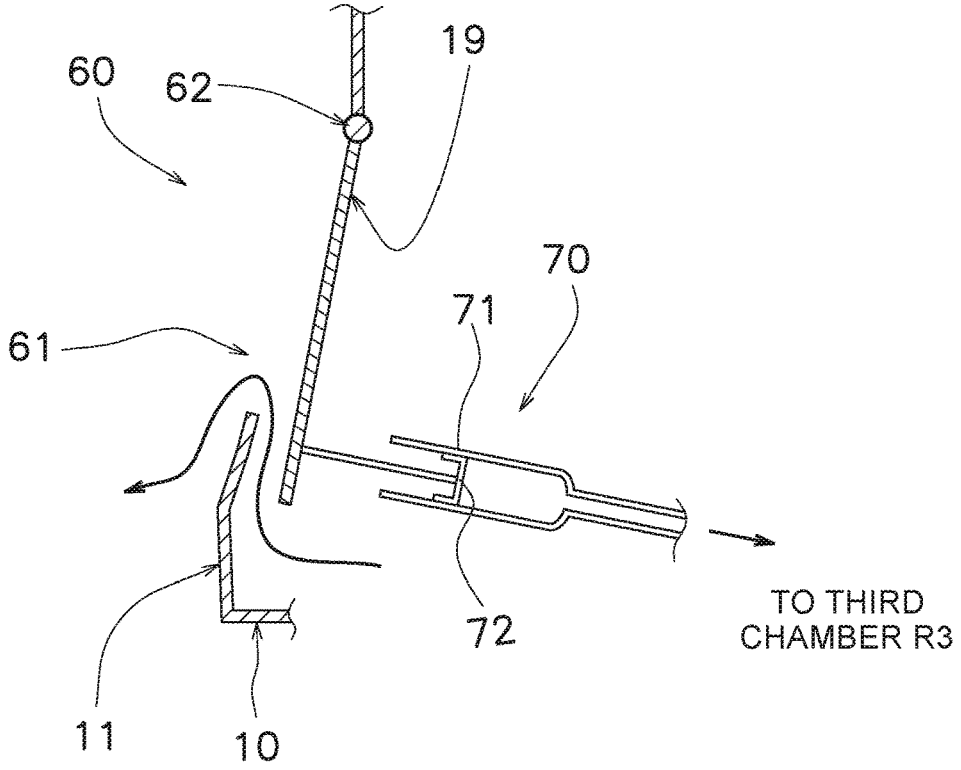
FIG. 10 is a schematic sectional view for describing a configuration of an opening and closing part according to Modification C.

In the above embodiments, the case has been described where a negative pressure generated by the first fan 31 is used for opening and closing the opening and closing part 60. However, a positive pressure generated by the first fan 31 may be used to open and close the opening and closing part 60. For example, as shown in FIG. 10, a positive pressure generated by the first fan 31 may be applied to the inside of a cylinder tube 71 to open and close the lid 61 by an air cylinder 70. For example, the cylinder tube 71 is connected to the third chamber R3. As shown in FIG. 7, in a state where the first fan 31 is driven, an air pressure in the third chamber R3 is higher than the atmospheric pressure Po. The air pressure of the third chamber R3 is applied to the cylinder tube 71 to drive a piston 72 of the air cylinder 70. When the first fan 31 is driven, the piston 72 moves toward the lid 61 to bring the lid 61 into close contact with the side plate 11 and close the opening 19. When the first fan 31 is stopped, the pressure in the cylinder tube 71 decreases. Therefore, the lid 61 pushes back the piston 72 by the weight of the lid 61, and the lid 61 opens the opening 19.

(3-4) Modification D

Figure 11:
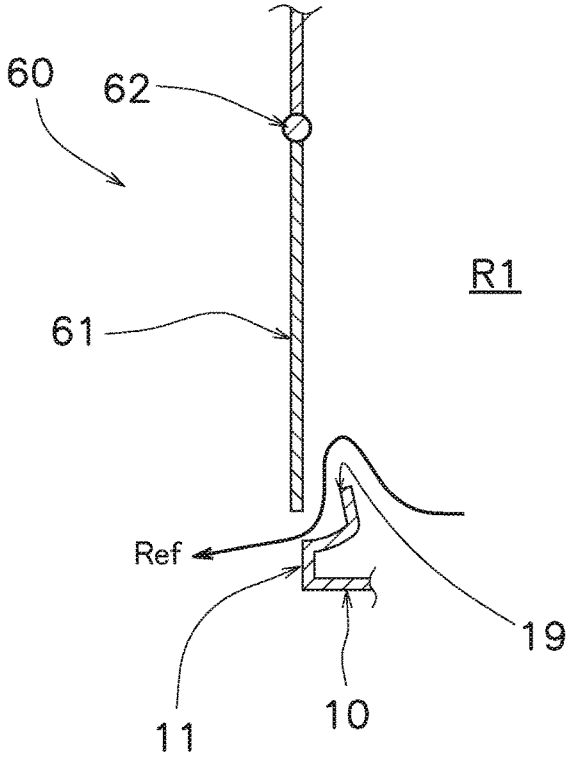
FIG. 11 is a schematic sectional view showing a state in which a lid of an opening and closing part according to Modification D is open.
Figure 12:
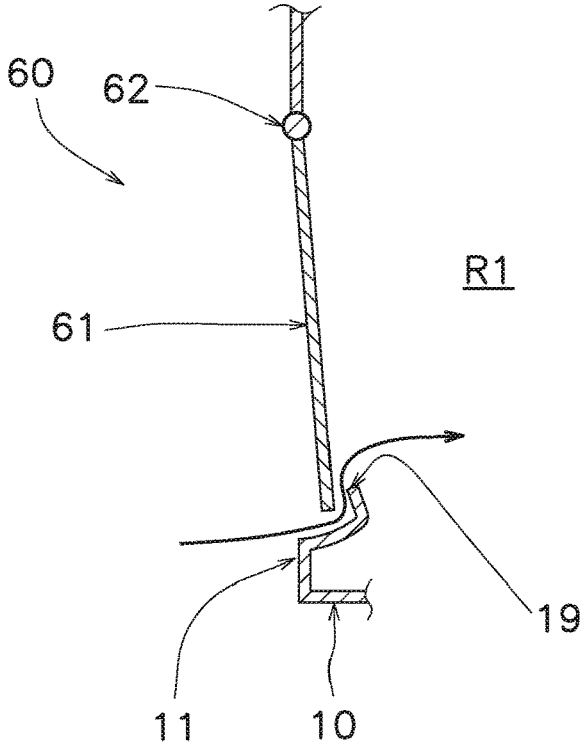
FIG. 12 is a schematic sectional view showing a state in which the lid of the opening and closing part according to Modification D is being closed.
Figure 13:
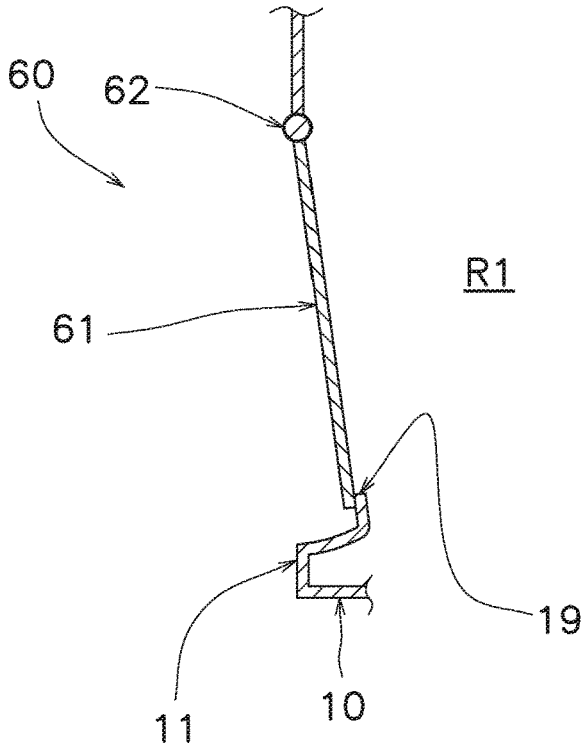
FIG. 13 is a schematic sectional view showing a state in which the lid of the opening and closing part according to Modification D is closed.

In the above embodiments, the lid is supported by the spring 63. However, as shown in FIGS. 11, 12, and 13, the lid 61 may be configured to maintain an open state by the weight of the lid 61 without using the spring 63. FIG. 11 shows a state in which the lid 61 hangs down in a vertical direction from the hinge 62 by the own weight of the lid 61. At this time, the first fan 31 is stopped. In the state shown in FIG. 11, a lower part of the lid 61 is separated from the side plate 11. When the lower part of the lid 61 is separated from the side plate 11, the opening 19 is opened. In the state shown in FIG. 11, the refrigerant Ref leaking into the first chamber R1 flows out of the casing 10 through the opening 19.

When the first fan 31 is driven, air is sucked into the casing 10 through behind the lid 61 as shown in FIG. 12. At this time, as in the above embodiments, the air pressure behind the lid 61 decreases, and a force from before the lid 61 to behind the lid 61 is generated. When the lid 61 is closed as shown in FIG. 13, the opening 19 is closed. In the state shown in FIG. 13, the weight of the lid 61 works to open the lid 61, but due to a low air pressure of the space in the first chamber R1, the lid 61 keeps the opening 19 closed.

(3-5) Modification E

Figure 14:
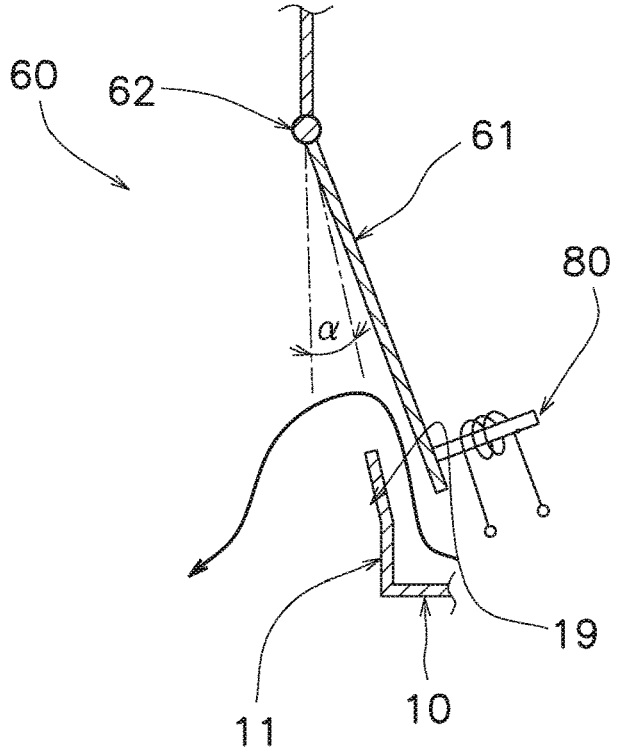
FIG. 14 is a schematic sectional view of an opening and closing part according to Modification E for describing a configuration of the opening and closing part.

The opening and closing part 60 according to the above embodiments opens and closes the lid 61 by using a change in the air pressure in the casing 10 generated by the first fan 31. However, the lid 61 may be opened and closed by using power other than the change in the air pressure in the casing 10. FIG. 14 shows an electromagnet 80. The electromagnet 80 is controlled by the control unit 50. The lid 61 includes, for example, iron, and thus is attracted to the electromagnet 80 when a current flows through the electromagnet 80. When the current flowing through the electromagnet 80 is cut off, the lid 61 is pressed against the side plate 11 by the weight of the lid 61. When the lid 61 is pressed against the side plate 11, the opening 19 is closed. At this time, the lid 61 is inclined by a [degrees] with respect to the vertical direction, and can keep in contact with the side plate 11 by the weight of the lid 61.

(3-6) Modification F

Figure 15:
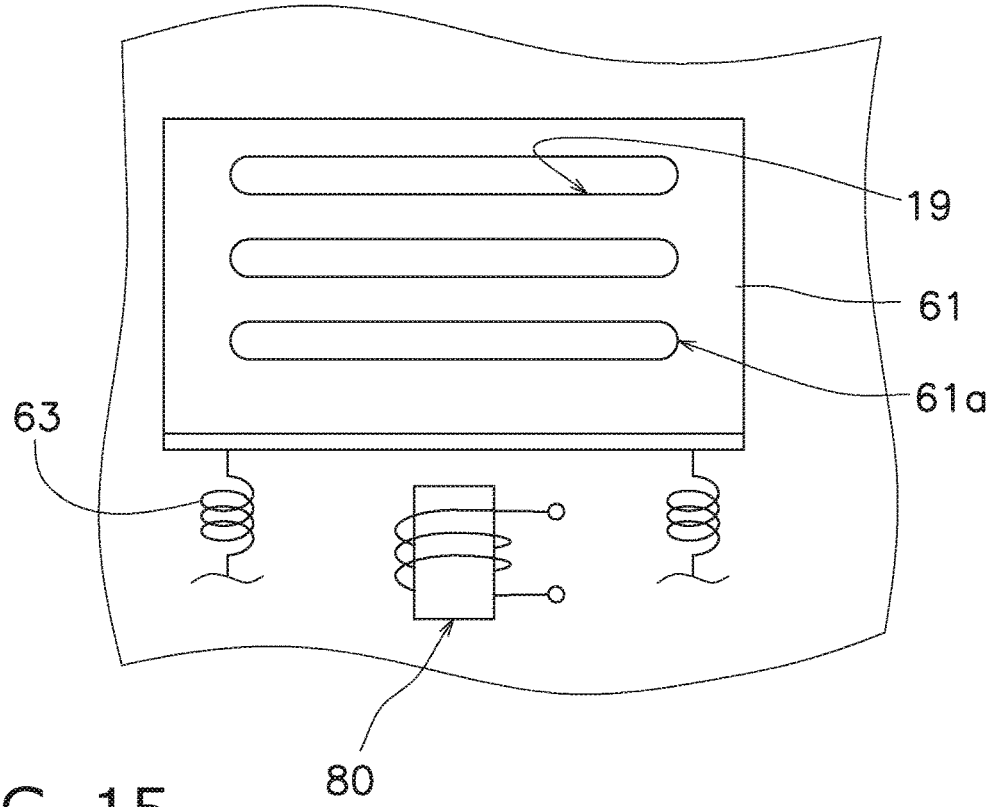
FIG. 15 is a schematic sectional view showing a state in which a lid of an opening and closing part according to Modification F is open.
Figure 16:
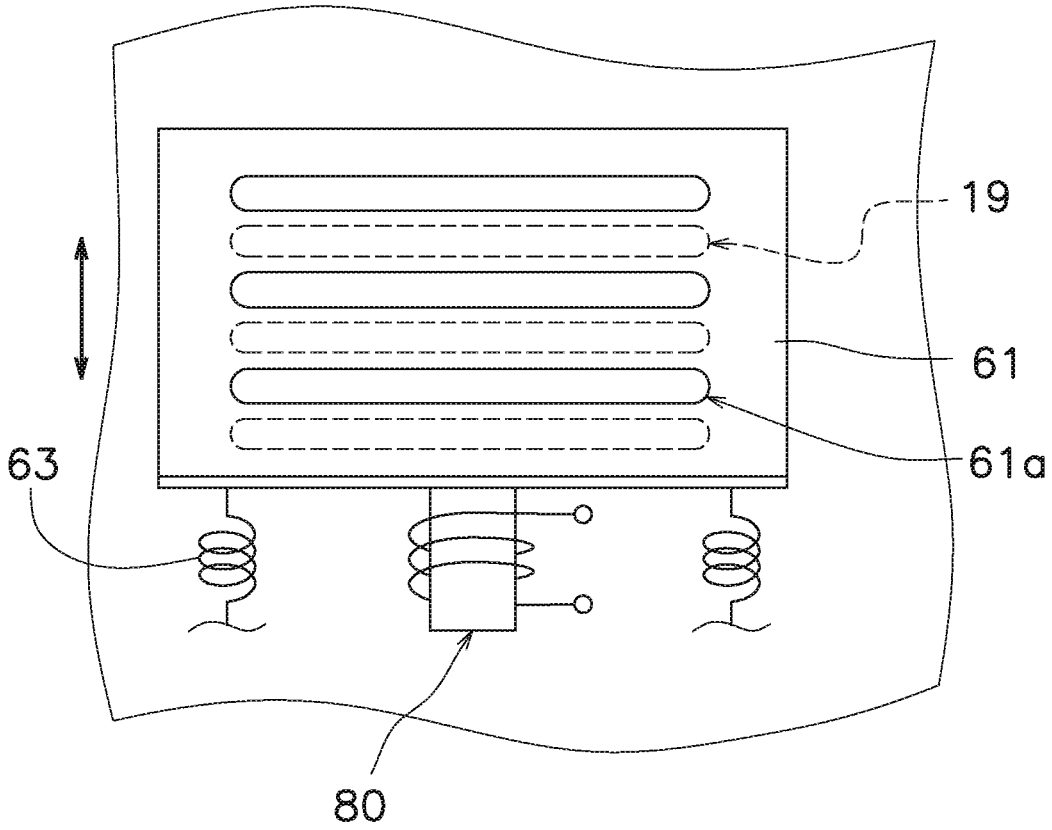
FIG. 16 is a schematic sectional view showing a state in which the lid of the opening and closing part according to Modification F is closed.

In the above embodiments, the case where the lid 61 rotationally moves when the opening and closing part 60 opens and closes the opening 19 has been described as an example. However, the movement of the lid 61 when the opening 19 is opened and closed is not limited to the rotational movement. For example, as shown in FIGS. 15 and 16, the opening and closing part 60 may open and close the opening 19 by translation (sliding) of the lid 61. FIG. 15 shows a state in which the opening 19 is not closed by the lid 61. In the state shown in FIG. 15, the opening 19 and the slit 61*a* of the lid 61 overlap each other. FIG. 16 shows a state in which the opening 19 is closed by the lid 61. In the state shown in FIG. 16, the opening 19 and the slit 61*a* of the lid 61 do not overlap each other.

The opening and closing part 60 switches between a state in which a current flows to the electromagnet 80 and a state in which the current does not flow to the electromagnet 80 to translate the lid 61 and open and close the lid 61. In the opening and closing part 60 in a state in which no current flows in the electromagnet 80, as shown in FIG. 15, the lid 61 is lifted by the spring 63, and the electromagnet 80 and the iron lid 61 are separated from each other. When a current flows through the electromagnet 80, as shown in FIG. 16, in the opening and closing part 60, the iron lid 61 is attracted to the electromagnet 80, and the lid 61 is translated downward against the repulsive force of the spring 63. As a result, the positions of the opening 19 and the slit 61*a* of the lid 61 are shifted, and the opening 19 is closed by the lid 61.

(3-7) Modification G

In the above embodiments, the case has been described where supply air SA is warmed by the furnace burner unit 40. However, other heating means may be provided in the casing 10 instead of the furnace burner unit 40. Instead of the furnace burner unit 40, for example, an electric heater may be provided in the third chamber R3 of the casing 10. The electric heater is a heating part.

(3-8) Modification H

In the above embodiments, the case has been described where the opening and closing part 60 is configured to open only when the first fan 31 is stopped. However, the opening and closing part 60 may be configured to open not only when the first fan 31 is stopped but also when the first fan 31 is driven and the following preset specific condition is satisfied. The specific condition for opening the opening and closing part 60 is, for example, a condition that energy can be saved by opening the opening and closing part 60. The opening and closing part 60 may be configured to be opened when the indoor temperature is higher than the outdoor temperature, for example, in a cooling operation mode of the air conditioner 1. The opening and closing part 60 of Modification H is configured to be always opened when the first fan 31 is stopped, and in addition, to be opened when the above-described specific condition is satisfied.

(4) Characteristics (4-1)

In the air conditioner 1 described above, there is a possibility that the refrigerant used in the evaporator 24 which is a heat exchanger leaks when the first fan 31 is stopped. However, since the opening and closing part 60 opens the opening 19 when the first fan 31 is stopped, the refrigerant can be released from the second chamber R2, the third chamber R3, and the fourth chamber R4, which are the arrangement space of the casing 10, to the outdoors through the opening 19. Since the air conditioner 1 has a simple configuration, sufficient safety can be secured at low cost.

In other words, the opening and closing part 60 shown in FIGS. 6 to 8 is a lid opening and closing device including the lid 61, the hinge 62, and the spring 63 (elastic body). In the lid opening and closing device, when the first fan 31 is driven, the opening 19 is automatically closed by a negative pressure generated in the casing 10 so that air cannot enter and exit between the first chamber R1 in the casing 10 and the outdoors. In the lid opening and closing device, when the first fan 31 is stopped, the opening 19 is automatically opened by the spring 63 (elastic body) so that air can enter and exit between the first chamber R1 in the casing 10 and the outdoors. The first chamber R1 is a space through which air can flow between the first chamber R1 and the arrangement space. Therefore, in a state where air cannot enter and exit between the first chamber R1 and the outdoors, air cannot enter and exit between the arrangement space and the outdoors. In addition, in a state where air can enter and exit between the first chamber R1 and the outdoors, air can enter and exit between the arrangement space and the outdoors.

The lid 61 is a part of a wall of the first chamber R1 in the casing 10 that has a negative pressure when the first fan 31 is driven. The lid 61 is attached to the opening 19 of the casing 10 by the hinge 62. Therefore, in the lid opening and closing device, when the first fan 31 is driven, the first chamber R1 has a negative pressure, and thus a force generated at the lid 61 exceeds a force generated by the spring 63. Then, the lid 61 is brought into close contact with the casing 10 to automatically close the opening 19. In the lid opening and closing device, when the first fan 31 is stopped, the force generated at the lid 61 due to the difference between the air pressures inside and outside the casing is reduced, and the lid 61 is separated from the opening 19 by the force generated by the spring 63, and the opening 19 is automatically opened.

In other words, the opening and closing part 60 shown in FIG. 10 is a lid opening and closing device including the lid 61, the hinge 62, and the air cylinder 70 (actuator). In the lid opening and closing device, when the first fan 31 is driven, the opening 19 is automatically closed by a positive pressure generated in the casing 10 so that air cannot enter and exit between the space in the casing 10 and the outdoors. In the lid opening and closing device, when the first fan 31 is stopped, the opening 19 is automatically opened by the weight of the lid 61 so that air can enter and exit between the space in the casing 10 and the outdoors. The space in the casing 10 is the arrangement space or a space through which air can flow between the first chamber R1 and the arrangement space.

In the lid opening and closing device, in a state where the first fan 31 is stopped, no force is generated in the air cylinder 70 (actuator), and the lid 61 is merely supported by the hinge 62, the lid 61 is separated from the casing 10 by the weight of the lid 61, and the opening 19 is automatically opened. In the lid opening and closing device, when the first fan 31 is driven, the third chamber R3 and the air cylinder 70 (actuator) have a positive pressure, and the force with which the piston 72 presses the lid 61 exceeds the force to open the lid 61 by the weight of the lid 61, and the lid 61 is brought into close contact with the casing 10 to automatically close the opening 19.

In other words, the opening and closing part 60 shown in FIGS. 11 to 13 is a lid opening and closing device including the lid 61 and the hinge 62. When the first fan 31 is driven, the first chamber R1 in the casing 10 has a negative pressure, and thus the opening 19 is automatically closed so that air cannot enter and exit between the first chamber R1 in the casing 10 and the outdoors. In the lid opening and closing device, when the first fan 31 is stopped, the opening 19 is automatically opened by the weight of the lid 61 so that air can enter and exit between the first chamber R1 in the casing 10 and the outdoors. The relationship between the first chamber R1 and the arrangement space is similar to the relationship described for the lid opening and closing device shown in FIG. 6.

The lid 61 is a part of a wall of the first chamber R1 in the casing 10 that has a negative pressure when the first fan 31 is driven. In the lid opening and closing device, when the first fan 31 is driven, the first chamber R1 has a negative pressure, and thus the force generated at the lid 61 exceeds the force to open the lid 61 by the weight of the lid 61. Then, the lid 61 is brought into close contact with the casing 10 to automatically close the opening 19. In the lid opening and closing device, when the first fan 31 is stopped, the force generated at the lid 61 due to the difference between the air pressures inside and outside the casing is reduced, and the lid 61 is separated from the opening 19 by the force generated by the weight of the lid 61, and the casing 10 is automatically opened.

In other words, the opening and closing part 60 shown in FIG. 14 is a lid opening and closing device including the lid 61, the hinge 62, and the electromagnet 80 (actuator). In the lid opening and closing device, when the first fan 31 is driven, the control unit 50 does not flow a current to the electromagnet 80 (actuator), and thus the opening 19 is automatically closed by the weight of the lid 61 so that air cannot enter and exit between the space in the casing 10 and the outdoors. In the lid opening and closing device, when the first fan 31 is stopped, the control unit 50 applies a current to the electromagnet 80 (actuator) to attract the lid 61 and automatically open the opening 19 so that air can enter and exit between the space in the casing 10 and the outdoors. The space in the casing 10 is the arrangement space or a space through which air can flow between the first chamber R1 and the arrangement space.

In the lid opening and closing device, when a current does not flow through the electromagnet 80 (actuator), the lid 61 is merely supported by the hinge 62, and the lid 61 is brought into close contact with the casing 10 by the weight of the lid 61 to automatically close the opening 19. In the lid opening and closing device, when a current flows through the electromagnet 80 (actuator), a force by which the electromagnet 80 (actuator) attracts the lid 61 exceeds a force to close the lid 61 by the weight of the lid 61, and thus the lid 61 is separated and the opening 19 is automatically opened.

In other words, the opening and closing part 60 shown in FIGS. 15 and 16 is a lid opening and closing device including the sliding lid 61, the electromagnet (actuator) 80, and the spring 63 (elastic body). In the lid opening and closing device, when the first fan 31 is driven, the control unit 50 causes a current to flow through the electromagnet 80 (actuator) to automatically close the opening 19 against the force of the spring 63 (elastic body) so that air cannot enter and exit between the space in the casing 10 and the outdoors. In the lid opening and closing device, when the first fan 31 is stopped, the control unit 50 applies a current to the electromagnet 80 (actuator) to attract the lid 61 and automatically open the opening 19 against the force of the spring 63 (elastic body) so that air can enter and exit between the space in the casing 10 and the outdoors. The space in the casing 10 is the arrangement space or a space through which air can flow between the first chamber R1 and the arrangement space.

In the lid opening and closing device, when no current flows through the electromagnet 80 (actuator), the opening 19 of the casing 10 and the slit 61*a* of the lid 61 overlap each other in a state where the lid 61 is supported by an elastic force of the spring 63 (elastic body), and the opening 19 is automatically opened. In the lid opening and closing device, when a current flows through the electromagnet 80 (actuator), a force by which the electromagnet 80 (actuator) attracts the lid 61 exceeds the elastic force of the spring 63 (elastic body), the slit 61*a* of the sliding lid 61 does not overlap the opening 19 of the casing 10, and thus the opening 19 is automatically closed.

(4-2)

In the air conditioner 1 described above, the negative pressure or the positive pressure generated by driving of the first fan 31 is used for opening and closing the lid 61 of the opening and closing part 60. Therefore, it is not necessary to newly provide a power source for opening and closing the lid 61. As a result, the air conditioner 1 including the opening and closing part 60 can be provided at low cost.

(4-3)

In the air conditioner 1 according to the above embodiments, a biasing force of the spring 63 which is an elastic body assists the movement of the lid 61, and thus reliability of an opening and closing operation of the lid 61 is improved.

(4-4)

In the air conditioner 1, the opening and closing operation of the opening 19 by the lid 61 is performed by the rotational movement or the translation of the lid 61. The rotational movement of the lid 61 can be achieved by the hinge 62, and the translation of the lid 61 can be achieved by sliding the lid 61. Therefore, the opening and closing operation of the lid 61 can be easily achieved.

(4-5)

When the movement of the lid 61 is assisted by the weight of the lid 61 in the air conditioner 1, it is possible to improve the reliability of the opening and closing operation of the lid 61. For example, in the opening and closing part 60 shown in FIGS. 10 to 14, a state in which the lid 61 is closed or opened can be maintained by the weight of the lid 61, and the reliability of the opening and closing operation of the lid 61 is improved.

(4-6)

The air cylinder 70 is used as an actuator in the opening and closing part 60 shown in FIG. 10, and the electromagnet 80 is used as an actuator in the opening and closing part 60 shown in FIGS. 14 to 16. Since an actuator such as the air cylinder 70 or the electromagnet 80 is used for opening and closing the lid 61 of the opening and closing part 60, the opening and closing of the lid 61 can be reliably controlled.

(4-7)

Since the air conditioner 1 according to the above embodiments includes the filter 67 that covers the opening 19, the filter 67 prevents entry of foreign matter such as an insect.

(4-8)

The air conditioner 1 can release a flammable refrigerant from the casing 10 to the outdoors through the opening 19 to prevent the leaking refrigerant from being accumulated in the casing 10 and burning even when the furnace burner unit 40 including a burner, the electric heater, and the electromagnetic relay 51 generate heat.

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

REFERENCE SIGNS LIST

1: air conditioner
10: casing
19: opening
24: evaporator (example of heat exchanger)
31: first fan (example of fan)
40: furnace burner unit (example of heating part, example of burner)
50: control unit
51: electromagnetic relay (example of electric apparatus)
60: opening and closing part
61: lid
63: spring (example of elastic body)
67: filter
70: air cylinder (example of actuator)
80: electromagnet (example of actuator)

PATENT LITERATURE

Patent Literature 1: JP 2015-94512 A

What is claimed is:

1. An air conditioner comprising:
a heat exchanger that exchanges heat between air sent to an air conditioning target space and a flammable refrigerant;
a fan that generates air flow in the heat exchanger;
one of:
a heater that heats the air sent to the air conditioning target space; or
an electric apparatus that is capable of causing electric discharge;
a casing that has:
an arrangement space in which the heat exchanger, the fan, and the heater or the electric apparatus are disposed; and
an opening that communicates the arrangement space with outdoors; and
an opening and closing part that comprises a lid that opens and closes the opening, wherein
the lid opens the opening when the fan is stopped and closes the opening by a negative pressure generated by operation of the fan.

2. The air conditioner according to claim 1, wherein the opening and closing part comprises an elastic body that biases the lid when the opening is opened or closed.

3. The air conditioner according to claim 1, wherein the opening and closing part opens and closes the opening by rotational movement of the lid or translation of the lid.

4. The air conditioner according to claim 1, wherein a weight of the lid causes the opening to be opened or closed.

5. The air conditioner according to claim 1, further comprising a filter that covers the opening.

6. The air conditioner according to claim 1, wherein the heater is a burner or an electric heater.

7. The air conditioner according to claim 1, wherein the electric apparatus is an electromagnetic relay or an electrostatic precipitator.

* * * * *